US010407271B1

(12) United States Patent
Downing

(10) Patent No.: US 10,407,271 B1
(45) Date of Patent: Sep. 10, 2019

(54) SENSOR ASSEMBLY CALIBRATION

(71) Applicant: HEWLETT-PACKARD DEVELOPMENT COMPANY, L.P., Houston, TX (US)

(72) Inventor: Elliott Downing, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/009,882

(22) Filed: Jun. 15, 2018

(51) Int. Cl.
*B65H 43/08* (2006.01)
*B65H 31/10* (2006.01)
*B65H 37/00* (2006.01)

(52) U.S. Cl.
CPC ..... *B65H 43/08* (2013.01); *B65H 31/10* (2013.01); *B65H 37/00* (2013.01); *B65H 2511/22* (2013.01); *B65H 2515/40* (2013.01); *B65H 2553/41* (2013.01); *B65H 2557/61* (2013.01)

(58) Field of Classification Search
CPC ..... B65H 2577/60; B65H 2577/61; B65H 2577/63; B65H 29/50; B65H 31/10; B65H 2557/60; B65H 2557/61; B65H 2557/63; B65H 43/08
See application file for complete search history.

(56) References Cited

U.S. PATENT DOCUMENTS

| | | | | |
|---|---|---|---|---|
| 6,464,414 | B1 | 10/2002 | Washnock | |
| 6,713,775 | B2 | 3/2004 | Chelvayohan et al. | |
| 7,463,376 | B2 | 12/2008 | Bezenek | |
| 8,469,483 | B2 | 6/2013 | Pawlik et al. | |
| 2005/0218588 | A1* | 10/2005 | Ohtsuka | G03G 15/6552 271/279 |
| 2016/0347082 | A1 | 12/2016 | Duckett et al. | |
| 2017/0253022 | A1 | 9/2017 | Henn et al. | |

FOREIGN PATENT DOCUMENTS

| | | | |
|---|---|---|---|
| JP | 2005169718 | A | 6/2005 |
| WO | WO-2017099747 | A1 | 6/2017 |

* cited by examiner

*Primary Examiner* — Howard J Sanders
(74) *Attorney, Agent, or Firm* — Trop Pruner & Hu P.C.

(57) ABSTRACT

In some examples, a controller receives an indication from the printing system to initiate a calibration. In response to the indication, the controller activates a sensor assembly as part of a calibration operation that comprises emitting a signal toward a calibration surface of the media output accumulator, and detecting a reflected signal responsive to the emitted signal. The controller calibrates the sensor assembly based on the reflected signal, the sensor assembly to detect a level of media sheets, ejected by the printing system, into the media output accumulator.

18 Claims, 5 Drawing Sheets

SENSOR ASSEMBLY CALIBRATION

BACKGROUND

A printing system can print images onto media sheets. A finisher can receive media sheets that have been printed by the printing system. The finisher includes an output bin to receive the media sheets ejected by the printing system.

BRIEF DESCRIPTION OF THE DRAWINGS

Some implementations of the present disclosure are described with respect to the following figures.

Figure 1:
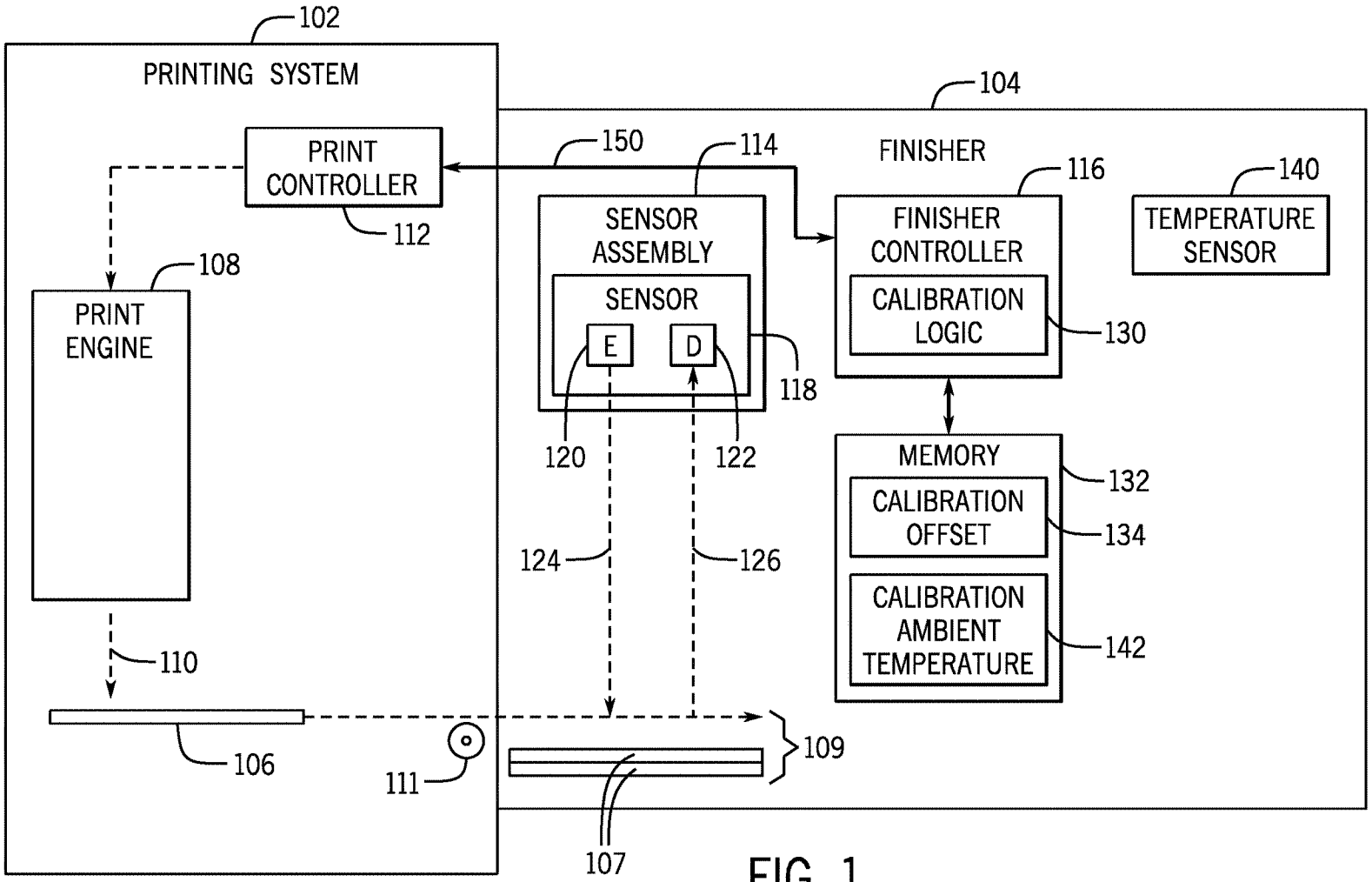
FIG. 1 is a block diagram of an arrangement that includes a printing system and a finisher, according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A finisher for a printing system can refer to a device that accumulates media sheets that have been printed by the printing system. A "media sheet" can refer to any substrate (formed of a paper, plastic, etc.) onto which an image (e.g., any or some combination of text, graphics, etc.) can be printed by an imaging engine of the printing system. For example, the imaging engine can dispense printing liquids (e.g., ink) onto a media sheet. As another example, the imaging engine can print images onto media sheets using laser printing, or other printing techniques.

In some cases, the finisher can apply a further finishing operation (in addition to accumulating media sheets) to media sheets, such as any or some combination of stapling of accumulated media sheets, sorting accumulated media sheets, folding accumulated media sheets, binding accumulated media sheets, and so forth. In some examples, a finisher can be integrated into the printing system such that the finisher is part of the printing system. In other examples, a finisher is separate from the printing system, but can be attached to the printing system to receive printed media sheets ejected by the printing system.

A finisher can include a sensor assembly to detect a level (or height) of the media sheets received in the finisher. If the sensor assembly indicates that the finisher is full (the level of media sheets has reached a specified threshold), then the printing system can cease printing and provide an alert to allow a user to remove media sheets from the finisher.

The accuracy of the sensor assembly can be affected by various factors. For example, the sensitivity of a particular sensor assembly (due to manufacturing tolerances associated with building the particular sensor assembly) can affect its accuracy. Furthermore, a sensor assembly is mounted at a location of the finisher to emit signals towards media sheets in the finisher, and to detect reflected signals responsive to the emitted signals from the media sheets. The detected reflected signals are used to calculate distances between the sensor assembly and the top of a stack of the media sheets in the finisher. The measured distances can vary if mounting positions of respective sensor assemblies in corresponding finishers vary.

A sensor assembly can also be sensitive to an ambient temperature of the sensor assembly. The ambient temperature of the sensor assembly refers to a temperature of an environment around the sensor assembly. Variations in the ambient temperature can cause variations in measured distances based on measurements by the sensor assembly.

In some examples, a manual calibration process can be used to calibrate a sensor assembly during development of the sensor assembly. In this manual calibration process, a human is tasked with placing a calibration block with a reflective surface in a detection path of the sensor assembly. The distance from the sensor assembly to a surface of the calibration block is known, and a measurement made by the sensor assembly with respect to the calibration block can be used to calibrate the sensor assembly. Such a manual calibration process may not be reliable if the calibration block is not placed in a correct position.

In accordance with some implementations of the present disclosure, a media accumulator device (such as a finisher) is provided with a self-calibration mechanism to allow the media accumulator device to initiate a calibration operation for calibrating a sensor assembly in response to an indication to initiate the calibration operation from a printing system. A media accumulator device can refer to any device that accumulates media sheets.

FIG. 1 is a block diagram of an example arrangement that includes a printing system 102 and a finisher 104 that is attached to the printing system 102. In some examples, the finisher 104 can be separate from the printing system 102, but can be attached to the printing system 102 to receive a media sheet 106 after printing has been performed on the media sheet 106. In other examples, the finisher 104 can be integrated into the printing system 102.

The printing system 102 includes a print engine 108, which causes printing (110) onto the media sheet 106. In some examples, the print engine 108 includes a liquid dispenser to dispense a printing liquid (e.g., ink) onto the media sheet 106 to form an image on the media sheet 106. The print engine 108 can include multiple liquid dispensers to dispense multiple different printing liquids (e.g., inks of different colors). In other examples, the print engine 108 can be a different type of print engine, such as that used in a laser printing system or other type of printing system.

The printing system 102 further includes a print controller 112, which is used to control the operation of the print engine 108 in printing images onto media sheets. As used here, the term "controller" can refer to a hardware processing circuit, such as any or some combination of a microprocessor, a core of a multi-core microprocessor, a microcontroller, a programmable integrated circuit device, a programmable gate array, and so forth. In other examples, a "controller" can refer to a combination of a hardware processing circuit and machine-readable instructions (software and/or firmware) executable on the hardware processing circuit.

In addition to controlling the print engine 108, the print controller 112 can also control relative movement of the print engine 108 and the media sheet 106, by controlling transport mechanisms that move either or both of a mounting structure attaching the print engine 108 and a media transport handler for the media sheet 106.

As shown in FIG. 1, a roller 111 that is part of the media transport handler can move the media sheet 106 along a path in the printing system 102. The roller 111 can also cause movement of the media sheet 106 into the finisher 104 when ejected from the printing system 102. In other examples, the media transport handler can include other types of mechanisms for moving media sheets.

As shown in FIG. 1, previous media sheets 107 have already been received in the finisher 104. The media sheet 106 ejected from the printing system 102 in a current printing operation is received in the finisher 104 and stacked onto the previously received media sheets 107. The combination of the media sheet 106 and the previous media sheets 107 form a stack 109 of media sheets.

The finisher 104 includes a sensor assembly 114 and a finisher controller 116. The sensor assembly includes a sensor 118 to output an indication corresponding to a distance between the sensor 118 and a target surface, which can be the top of the stack 109 of media sheets, or alternatively, a media receiving surface in the finisher 104 prior to receipt of any media sheet.

In some examples, the sensor 118 includes a signal emitter 120 and a signal detector 122. The signal emitter 120 emits a signal ("emitted signal 124") that is directed towards the target surface. The emitted signal 124 is reflected from the target surface, and directed back to the sensor 118 as a reflected signal 126. The reflected signal 126 is received by the signal detector 122.

In some examples, the sensor 118 is a time-of-flight (ToF) sensor that has an optical emitter (e.g., that emits an infrared or IR light) and an optical detector (e.g., that detects an IR light). In other examples, other types of sensors can be used that are able to measure a distance between the sensor 118 and the target surface.

Although not shown, the sensor assembly 114 can also include electronic circuitry that allows for the sensor 118 to communicate with the finisher controller 116. For example, the sensor assembly 114 can include a printed circuit board on which the signal emitter 120 and signal detector 122 are mounted. The printed circuit board includes further circuitry (e.g., an analog-to-digital converter, a digital-to-analog converter, an amplifier, etc.) to communicate over a link (wired or wireless link) with the finisher controller 116. In other examples, the sensor assembly 114 can be formed as an integrated circuit die that includes the signal emitter 120 and signal detector 122.

The finisher controller 116 is able to control activation of the sensor assembly 114, and to receive measurement data from the sensor assembly 114, where the measurement data includes data based on measured signals by the signal detector 122. If the stack 109 of media sheets is present in the finisher 104, then the measurement data from the sensor assembly 114 can provide an indication of a level of the stack 109 of media sheets.

In addition to activating the sensor assembly 114 for detecting the level of the stack 109 of media sheets during a finisher operation of the finisher 104, a calibration logic 130 of the finisher controller 116 is able to perform a calibration operation in the finisher 104 to calibrate the sensor assembly 114. The calibration logic 130 can be implemented using a portion of the hardware processing circuit of the finisher controller 116. Alternatively, the calibration logic 130 can be implemented as machine-readable instructions executable by the finisher controller 116.

The calibration logic 130 can control self-calibration of the sensor assembly 114 by the finisher 104 in response to an indication to initiate a calibration received from the printing system 102. The indication to initiate the calibration can be received over a communication link 150 (wired or wireless link) between the printing system 102 and the finisher 104. "Self-calibration" refers to a calibration operation where a human is not involved in manually placing a calibration block in a signal path of the sensor assembly 114 for the purpose of calibrating the sensor assembly 114. A calibration operation is performed when the stack 109 of media sheets is not present in the finisher 104. As explained below, a calibration operation can be performed with just a single media sheet (or some other predefined number of media sheets) in the finisher 104, or with no media sheet in the finisher 104.

The calibration of the sensor assembly 114 as performed by the calibration logic 130 includes computing a calibration offset that is used during a finisher operation to adjust a measurement made by the sensor 118. The calibration offset is used to adjust the measurement of the sensor 118 to account for any deviation of the sensor 118 with respect to an expected performance of the sensor 118, which can be due to manufacturing tolerances associated with the manufacture of the sensor 118, or tolerances associated with mounting of the sensor assembly 114 in the finisher 104.

The finisher 104 further includes a memory 132, which can store a calibration offset 134 computed by the calibration logic 130. The memory 132 can be implemented using a memory device (or multiple memory devices), including a dynamic random access memory (DRAM), a static random access memory, a flash memory, and so forth. Alternatively, the memory 132 can be implemented using a storage device (or multiple storage devices), including a disk-based storage, a solid state storage, and so forth.

The memory 132 can be part of the finisher controller 116, or can be external of the finisher controller 116 but accessible by the finisher controller 116.

The calibration offset 134 is accessible by the finisher controller 116 to adjust measurement data from the sensor 118. The adjustment of measurement data can include adding the calibration offset to the measurement data, subtracting the calibration offset from the measurement data, or otherwise computing an output value based on the measurement data and the calibration offset 134 according to a specified function, formula, and so forth.

In some examples, the finisher 104 further includes a temperature sensor 140 to measure an ambient temperature of the sensor assembly 114. The ambient temperature can refer to a temperature within the finisher 104 in which the sensor assembly 114 is located. Alternatively, the ambient temperature can refer to a temperature of an external environment around the finisher 104. In another example, the temperature sensor 140 can be located in the printing system 102, with the temperature measurement from the temperature sensor 140 sent to the finisher controller 116.

The calibration logic 130 can receive an ambient temperature measurement of the temperature sensor 140 during a calibration operation that calibrates the sensor assembly 114, where the ambient temperature measurement measures an ambient temperature of the sensor assembly 114. The measured ambient temperature taken during the calibration operation is stored as a calibration ambient temperature 142 in the memory 132.

The finisher controller 116 accesses the calibration ambient temperature 142 during a finisher operation to adjust the calibration offset 134 to account for a temperature difference between the calibration ambient temperature 142 and a measured temperature during the finisher operation of the finisher 104.

Note that the calibration offset 134 is computed at a given ambient temperature during the calibration operation, as represented by the calibration ambient temperature 142. During a finisher operation, the ambient temperature as measured by the temperature sensor 140 may be different, such that the calibration offset 134 may no longer be accurate. To account for the temperature variation, the finisher controller 116 can determine the temperature difference between the ambient temperature during the finisher operation and the calibration ambient temperature 142, and use that temperature difference to adjust the calibration offset 134 to produce an adjusted calibration offset. The adjustment of the calibration offset 134 based on the temperature difference can be a linear adjustment or a non-linear adjustment based on a characterization of how the calibration offset varies with different temperature differences. The adjusted calibration offset is then used in adjusting measurement data from the sensor assembly 114 representing a level of the stack 109 of media sheets.

Figure 2A:
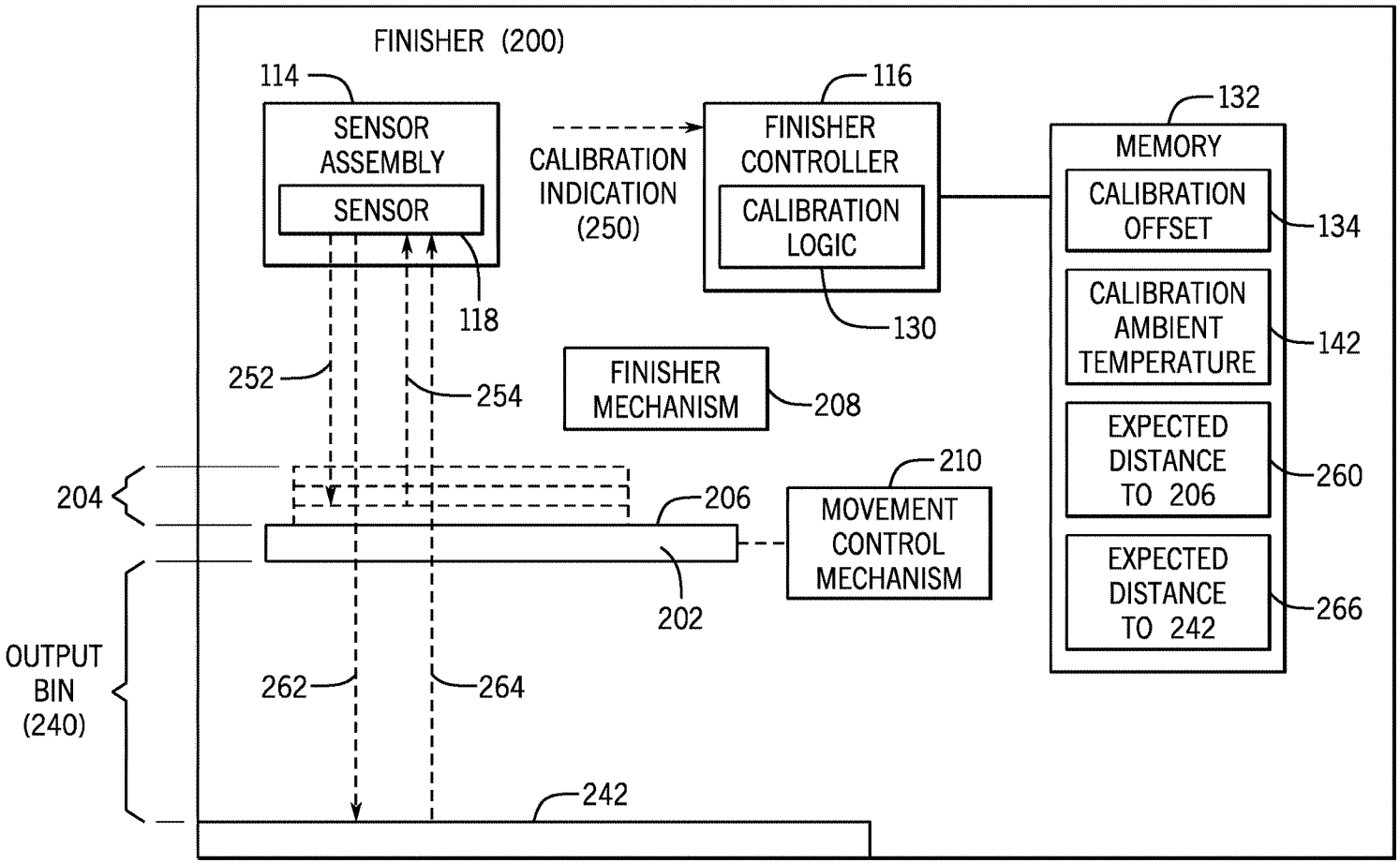
FIG. 2A is a block diagram of a finisher according to some examples.

FIG. 2A is a block diagram of a finisher 200 according to further examples. Similar to the finisher 104 of FIG. 1, the finisher 200 includes the sensor assembly 114 and the finisher controller 116 that has a calibration logic 130.

The finisher 200 further includes a moveable media platform 202, onto which media sheets ejected by a printing system (e.g., 102 in FIG. 1) can be provided. The media sheets ejected by the printing system are accumulated on a media receiving surface 206 of the moveable media platform 202, and the received media sheets are accumulated to form a stack 204 of media sheets on the media receiving surface 206 of the moveable media platform 202.

The finisher 200 further includes a finisher mechanism 208, which can apply a finishing operation to the stack 204 of media sheets. The finishing operation that can be applied by the finisher mechanism 208 can include stapling of the stack 204 of media sheets, folding of the stack 204 of media sheets, binding of the stack 204 of media sheets, and so forth.

The finisher 200 further includes a movement control mechanism 210, which can control the movement of the moveable media platform 202. In some examples, the movement control mechanism 210 can include a motor and other moveable elements controlled by the motor to move the moveable media platform 202.

Figure 2C:
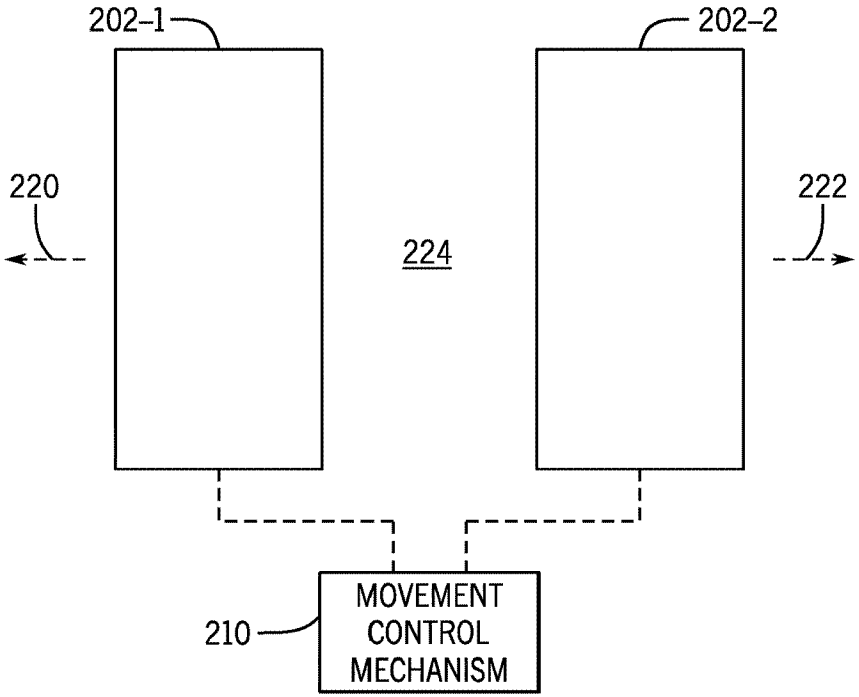
FIGS. 2B and 2C are block diagrams of different states of a moveable media platform of a finisher according to some examples.
Figure 2B:
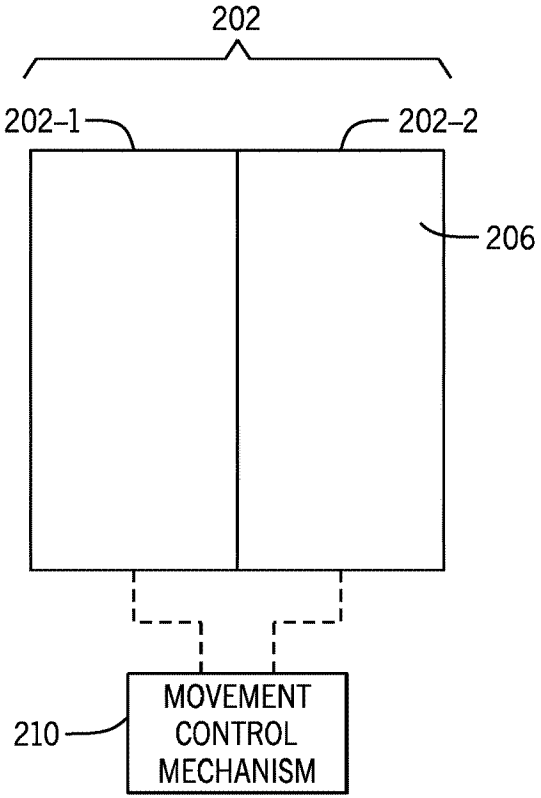

FIGS. 2B and 2C show a top view of an example of movement of the moveable media platform 202 (when looking down onto the media receiving surface 206). The moveable media platform 202 includes a first platform portion 202-1 and a second platform portion 202-2. When activated, the movement control mechanism 210 causes the platform portions 202-1 and 202-2 to move away from one another, as indicated by arrows 220 and 222 in FIG. 2C. Moving the platform portions 202-1 and 202-2 away from another causes a gap 224 to be formed between the platform portions 202-1 and 202-2, such that the stack 204 of media sheets can fall into an output bin 240 of the finisher 200 (FIG. 2A). The output bin 240 also has a media receiving surface 242 to receive the stack 204 of media sheets.

In other examples, instead of sliding the platform portions 202-1 and 202-2 away from another, the movement control mechanism 210 can cause other motion (such as pivoting motion, etc.) of a portion of the moveable media platform 202 to cause the stack 204 of media sheets on the moveable media platform 202 to fall into the output bin 240.

As further shown in FIG. 2A, the finisher controller 116 receives a calibration indication 250, which can be transmitted by a print controller (e.g., 112 in FIG. 1) of a printing system (e.g., 102 in FIG. 1) over a communication link (e.g., 150 in FIG. 1). The calibration indication 250 can be in the form of a message, a signal, an information element, or any other indicator that indicates that a calibration operation is to begin by the finisher 200. The calibration indication 250 can be sent by the printing system to the finisher controller 116 in response to a user request, such as by a user activating a control element (e.g., activating a control element on a graphical user interface displayed by the printing system, pushing a button on the printing system, etc.). Alternatively, the calibration indication 250 can be sent by the printing system to the finisher controller 116 in response to a request from a machine or a program executed in the printing system.

In response to the calibration indication 150, the calibration logic 130 initiates the calibration operation of the sensor assembly 114.

In response to the calibration indication 150, the calibration logic 130 determines whether a media output accumulator is empty of media sheets. In the example of FIG. 2A, the media output accumulator includes the moveable media platform 202 and/or the output bin 240. Although not shown, a sensor or multiple sensors can be provided to detect presence of a media sheet (or multiple media sheets) on the moveable media platform 202 and/or the output in the output bin 240.

In response to detecting that the media output accumulator is empty, the calibration logic 130 can begin the calibration operation. In some examples, to perform the calibration operation, a media sheet is provided (such as by the printing system) onto the media receiving surface 206 of the moveable media platform 202. For example, the calibration logic 130 can cause the finisher controller 116 to send an indication to the printing system, to cause the printing system to eject a single media sheet (or a specified number of media sheets) into the finisher 200.

In other examples, a media sheet on the media receiving surface 206 is not used in the calibration operation.

The calibration logic 130 activates the sensor assembly 114 to cause the sensor 118 to emit a calibration signal 252 towards the media receiving surface 206 of the moveable media platform 202. A reflected signal 254 responsive to the emitted signal 252 is reflected from the surface of the media sheet on the media receiving surface 206. The reflected signal 254 is received by the sensor 118.

In examples where a media sheet is not present in the finisher 200 when performing the calibration operation, the reflected signal 254 responsive to the emitted signal 252 is reflected from the media receiving surface 206 of the moveable media platform 202.

More generally, the reflected signal 254 is reflected from a calibration surface used for the calibration operation, where the calibration surface can include a surface of a media sheet, a media receiving surface, or a surface of another object that can be placed in the finisher for calibration purposes.

The calibration logic 130 has information regarding the expected distance between the sensor assembly 114 and the media receiving surface 206 (or more generally, a calibration surface). This expected distance 260 can be stored in the memory 132 (FIG. 1) for example.

The sensor assembly 114 provides measurement data based on the reflected signal 254 to the finisher controller 116. If the sensor 118 of the sensor assembly 114 is a ToF sensor, then the measurement data provided to the finisher controller 116 includes a time of flight that represents an amount of time between a time of the emitted signal 252 (the time at which the emitted signal 252 is emitted), and a time of the reflected signal 254 (a time at which a reflected signal 254 was received by the sensor 118).

The calibration logic 130 can use this measurement data to calculate a measured distance between the sensor assembly 114 and the target surface (e.g., the surface of the media sheet on the media receiving surface 206, or the media receiving surface 206, or another calibration surface). The calibration logic 130 can compare the measured distance with the expected distance 260. The difference between the measured distance and the expected distance 260 is used to derive the calibration offset 134 that can be stored by the calibration logic 130 in the memory 132. For example, the calibration offset 134 can be equal the difference between the measured distance and the expected distance 260.

After the calibration operation is performed with respect to the moveable media platform 202, the finisher controller 116 activates the movement control mechanism 210 to open the moveable media platform 202 (FIG. 2C), to allow the media sheet used in the calibration operation to drop to the media receiving surface 242 of the output bin 240. In other examples, if a media sheet is not used in the calibration operation performed with respect to the moveable media platform 202, the moveable media platform 202 would simply open.

A verification operation is then performed by the calibration logic 130 to verify the calibration performed on the sensor assembly 114 with respect to the moveable platform 202. In other words, the calibration logic 130 verifies, in the verification operation, whether the calibration offset 134 computed in the calibration operation is accurate or reasonable based on preset tolerance values.

In the verification operation, the calibration logic 130 activates the sensor assembly 114 to cause the sensor 118 to emit an emitted signal 262 towards the media receiving surface 242. A reflected signal 264 responsive to the emitted signal 262 is reflected, either from the media sheet that is on the media receiving surface 242 or directly from the media receiving surface 242. The reflected signal 264 is detected by the sensor 118. Measurement data based on the reflected signal 264 is provided to the finisher controller 116.

The calibration logic 130 has access to information specifying an expected distance 266 between the sensor assembly 114 and the media receiving surface 242 of the output bin 240. If the measurement data based on the reflected signal 264 indicates a measured distance that is the same as (or within a specified tolerance of) the expected distance, then the calibration logic 130 is able to verify that the calibration offset 134 calculated for the sensor assembly 114 is accurate.

Figure 3:
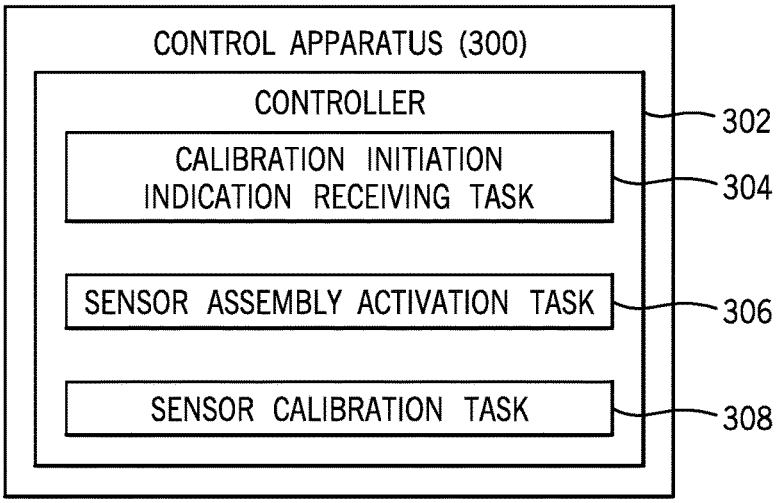
FIG. 3 is a block diagram of a calibration apparatus for a media output accumulator, according to some examples.

FIG. 3 is a block diagram of a calibration apparatus 300 for a media output accumulator useable with a printing system. The media output accumulator can include a finisher, or can be a portion of a finisher, for example. The calibration apparatus 300 includes a controller 302 to perform various tasks. The tasks of the controller 302 include a calibration initiation indication receiving task 304 that receives an indication from the printing system to initiate a calibration. In response to the indication, the tasks of the controller 302 include a sensor assembly activation task 306 that activates a sensor assembly as part of a calibration operation that comprises emitting a signal toward a calibration surface in the media output accumulator, and detecting a reflected signal responsive to the emitted signal.

The tasks of the controller 302 further include a sensor calibration task 308 to calibrate the sensor assembly based on the reflected signal.

Figure 4:
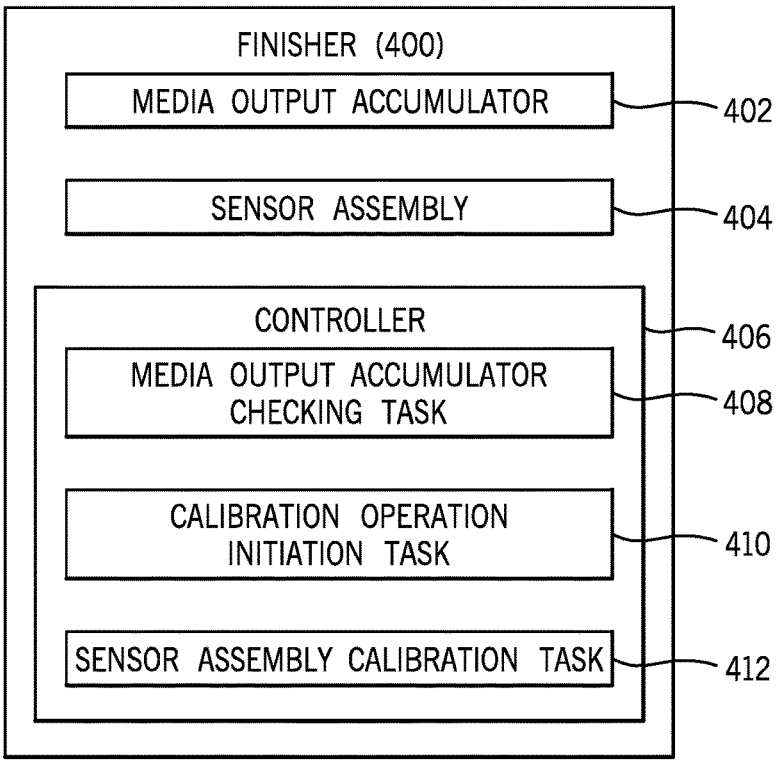
FIG. 4 is a block diagram of a finisher according to further examples.

FIG. 4 is a block diagram of a finisher 400 for a printing system, in accordance with further implementations. The finisher 400 includes a media output accumulator 402 to receive media sheets ejected by the printing system. The finisher 400 further includes a sensor assembly 404, and a controller 406 to perform various tasks in response to a request to initiate a calibration operation for the sensor assembly. The tasks of the controller 406 include a media output accumulator checking task 408 that checks that the media output accumulator is empty of media sheets. The tasks further include a calibration operation initiation task 410 to, in response to the media output accumulator being empty of media sheets, initiate a calibration operation that activates the sensor assembly to emit a signal toward a calibration surface in the media output accumulator, and detect a reflected signal responsive to the emitted signal. The tasks further include a sensor assembly calibrating task 412 that calibrates the sensor assembly based on the reflected signal.

Figure 5:
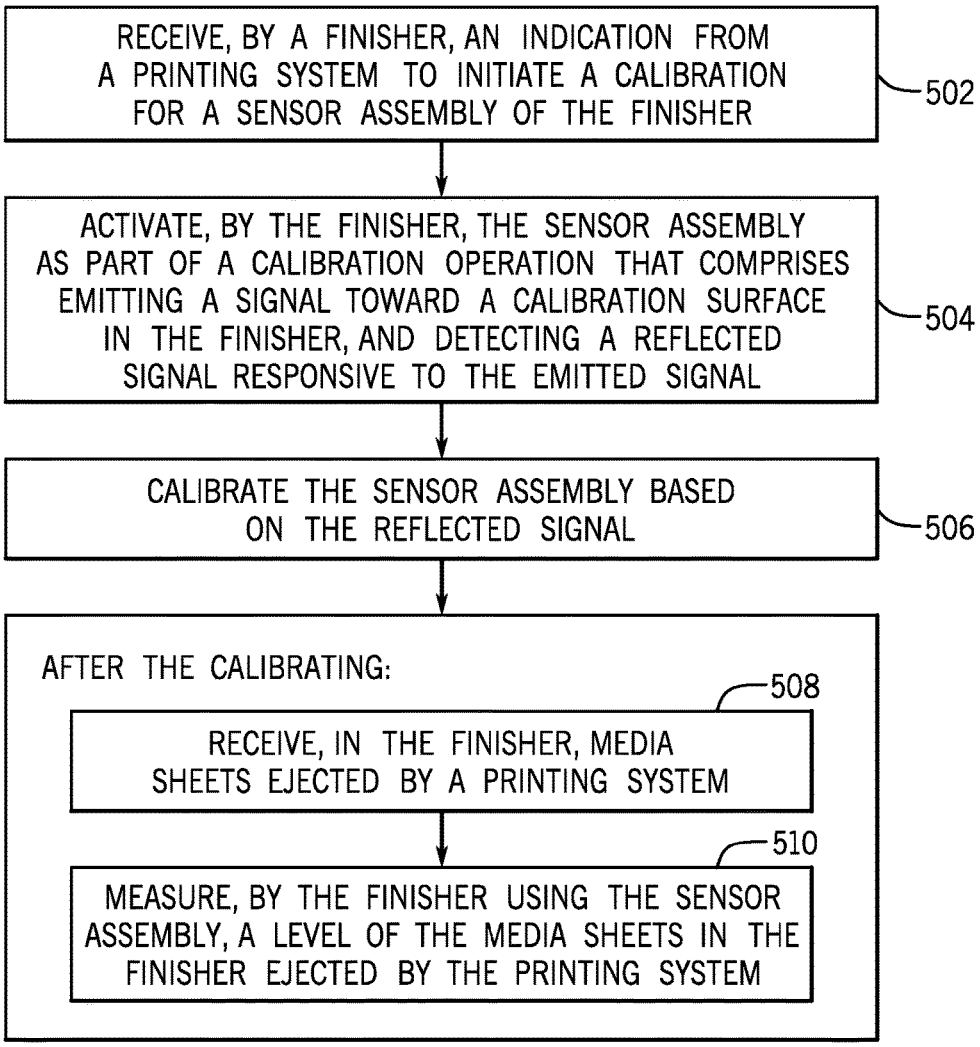
FIG. 5 is a flow diagram of a process according to some examples.

FIG. 5 is a flow diagram of a process according to some examples. The process of FIG. 5 includes receiving (at 502), by a finisher, an indication from a printing system to initiate a calibration for a sensor assembly of the finisher. In response to the indication, the process includes activating (at 504), by the finisher, the sensor assembly as part of a calibration operation that comprises emitting a signal toward a calibration surface in the finisher, and detecting a reflected signal responsive to the emitted signal. The process includes calibrating (at 506) the sensor assembly based on the reflected signal. After the calibrating, the process includes receiving (at 508), in the finisher, media sheets ejected by a printing system, and measuring (at 510), by the finisher using the sensor assembly, a level of the media sheets in the finisher ejected by the printing system.

In examples where the calibration logic 130 and/or other logic includes machine-readable instructions, the machine-readable instructions can be stored in a non-transitory machine-readable or computer-readable storage medium. The storage medium can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site (e.g., a cloud) from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A calibration apparatus for a media output accumulator useable with a printing system, comprising:

a controller to:

receive an indication from the printing system to initiate a calibration;

in response to the indication, check that the media output accumulator is empty of media sheets before initiating the calibration operation;

in response to the indication, activate a sensor assembly as part of a calibration operation that comprises emitting a signal toward a calibration surface in the media output accumulator, and detecting a reflected signal responsive to the emitted signal; and calibrate the sensor assembly based on the reflected signal, the sensor assembly to detect a level of media sheets, ejected by the printing system, into the media output accumulator.

2. The calibration apparatus of claim 1, wherein the indication is responsive to a user selection of a control element of the printing system.

3. The calibration apparatus of claim 1, wherein the sensor assembly comprises a sensor to provide an indication corresponding to a distance between the sensor and a target.

4. The calibration apparatus of claim 1, wherein the reflected signal is reflected from a media sheet supported by a media receiving surface in the media output accumulator, the calibration surface comprising a surface of the media sheet.

5. The calibration apparatus of claim 1, wherein the reflected signal is reflected from a media receiving surface in the media output accumulator, the calibration surface comprising the media receiving surface.

6. The calibration apparatus of claim 1, wherein the controller is to:

in response to a determination that the media output accumulator is empty of media sheets, communicate with the printing system to cause the printing system to eject a media sheet into the media output accumulator to initiate the calibration operation.

7. The calibration apparatus of claim 1, wherein to calibrate the sensor assembly the controller is to determine a calibration offset to adjust a measurement of the sensor assembly.

8. The calibration apparatus of claim 7, further comprising:

a temperature sensor to measure an ambient temperature of the sensor assembly during the calibration operation, wherein the controller is to store the measured ambient temperature for use in adjusting the calibration offset to account for a temperature difference between, the measured ambient temperature during the calibration operation and a measured temperature during an operation of the media output accumulator.

9. A finisher for a printing system, comprising:

a media output accumulator to receive media sheets ejected by the printing system;

a sensor assembly; and a controller to, in response to a request to initiate a calibration operation for the sensor assembly:

check that the media output accumulator is empty of media sheets;

in response to the media output accumulator being empty of media sheets, initiate a calibration operation that activates the sensor assembly to emit a signal toward a calibration surface in the media output accumulator, and detect a reflected signal responsive to the emitted signal, and calibrate the sensor assembly based on the reflected signal.

10. The finisher of claim 9, wherein the controller is to:

initiate the calibration operation by causing ejection of a media sheet onto a media receiving surface in the media output accumulator, wherein the reflected light is to be reflected from the media sheet on the media receiving surface, the calibration surface comprising a surface of the media sheet.

11. The finisher of claim 10, wherein the calibration surface is part of a movable platform in the media output accumulator, the controller to:

activate the movable platform to drop the media sheet into an output bin in the media output accumulator after the calibration operation;

after the media sheet has dropped into the output bin, activate the sensor assembly to emit a signal toward the media sheet in the output bin, and detect a reflected signal from the media sheet in the output bin; and verify the calibrating of the sensor assembly based on the reflected signal from the media sheet in the output bin.

12. The finisher of claim 11, wherein the controller is to:

use the reflected signal from the media sheet in the output bin to verify that a calibration offset calculated in the calibration operation is accurate.

13. The finisher of claim 9, wherein the controller is to:

after the calibration operation, use the sensor assembly to measure a height of media sheets in the media output accumulator.

14. The finisher of claim 9, wherein the calibration surface comprises a media receiving surface to accumulate the media sheets ejected by the printing system, and the finisher is to apply finishing to the accumulated media sheets on the media receiving surface.

15. The finisher of claim 9, wherein the calibrating of the sensor assembly comprises determining an offset to adjust a measurement of the sensor assembly, the finisher further comprising:

wherein the controller is to store a measured ambient temperature for use in adjusting the offset to account for a temperature difference between the measured ambient temperature during the calibration operation and a measured temperature during an operation of the finisher, the measured ambient temperature received from a temperature sensor that measures an ambient temperature of the sensor assembly during the calibrating.

16. A method comprising:

receiving, by a finisher, an indication from a printing system to initiate a calibration for a sensor assembly of the finisher;

in response to the indication, checking that the finisher is empty of media sheets, in response to the indication and in response to determining that the finisher is empty of media sheets, activating, by the finisher, the sensor assembly as part of a calibration operation that comprises emitting a signal toward a calibration surface of the finisher, and detecting a reflected signal responsive to the emitted signal;

calibrating the sensor assembly based on the reflected signal; and after the calibrating:

receiving, in the finisher, media sheets ejected by a printing system, and measuring, by the finisher using the sensor assembly, a level of the media sheets in the finisher ejected by the printing system.

17. The method of claim 16, wherein the indication is responsive to user activation of a control element of the printing system.

18. The method of claim 16, further comprising:

interacting, by the finisher with the printing system, to cause the printing system to eject a media sheet to the finisher to begin the calibration operation.

* * * * *